US010477956B2

(12) United States Patent
Lim

(10) Patent No.: US 10,477,956 B2
(45) Date of Patent: Nov. 19, 2019

(54) COSMETIC SYSTEMS

(71) Applicant: HCT Group Holdings Limited, Santa Monica, CA (US)

(72) Inventor: Cindy Sean Yuei Lim, Santa Monica, CA (US)

(73) Assignee: HCT Group Holdings Limited, Hong Kong (HK)

( * ) Notice: Subject to any disclaimer, the term of this patent is extended or adjusted under 35 U.S.C. 154(b) by 613 days.

(21) Appl. No.: 13/971,734

(22) Filed: Aug. 20, 2013

(65) Prior Publication Data

US 2015/0053233 A1 Feb. 26, 2015

(51) Int. Cl.

| | |
|---|---|
| ***A45D 26/00*** | (2006.01) |
| ***A46B 15/00*** | (2006.01) |
| ***A45D 40/00*** | (2006.01) |
| ***A45D 40/18*** | (2006.01) |
| ***A45D 40/20*** | (2006.01) |
| ***A46B 9/02*** | (2006.01) |

(52) U.S. Cl.

CPC ..... *A46B 15/0061* (2013.01); *A45D 26/0066* (2013.01); *A45D 40/00* (2013.01); *A45D 40/18* (2013.01); *A45D 40/20* (2013.01); *A46B 9/021* (2013.01); *A46B 15/0055* (2013.01); *A45D 2026/008* (2013.01); *A45D 2040/0025* (2013.01)

(58) Field of Classification Search

CPC .... A45D 26/0066; A45D 40/00; A45D 40/18; A45D 40/20; A45D 2026/008; A46B 15/0055; A46B 15/0061; A46B 15/0079; A46B 15/0065

USPC ..... 132/147, 148, 216, 218, 313, 317, 333; 16/111.1; 606/210, 211; D28/25, 55; 206/581, 234, 361

See application file for complete search history.

(56) References Cited

U.S. PATENT DOCUMENTS

| | | | |
|---|---|---|---|
| 544,452 | A | 8/1895 | Young et al. |
| D27,690 | S | 9/1897 | Waite |
| 715,881 | A | 12/1902 | Scott |
| 783,937 | A | 2/1905 | Edwards et al. |
| 987,277 | A | 3/1911 | Wright |

(Continued)

FOREIGN PATENT DOCUMENTS

| | | | |
|---|---|---|---|
| CN | 1196212 | A | 10/1998 |
| CN | 201192160 | Y | 2/2009 |

(Continued)

OTHER PUBLICATIONS

Amazon: L'Oreal Brow Stylist Professional 3-in-1 brow tool; retrived on Jun. 27, 2013 at: http://www.amazon.com/LOreal-Brow-Stylist-Professional-Blonde/dp/B001KYO7AY; 5 pages.

(Continued)

*Primary Examiner* — Tatiana L Nobrega

(74) *Attorney, Agent, or Firm* — Seager, Tufte & Wickhem LLP

(57) ABSTRACT

Two-in-one cosmetic systems having a tweezer removably disposed in a handle are disclosed. The tweezer may be removably disposed in a handle of the applicator, such that the tweezer is restrained and a pinching tip of the tweezer is in a closed position. By virtue of having a tweezer restrained and having a pinching tip in a closed position, the pinching tip of the tweezers remain sharp and undamaged until a time of use.

4 Claims, 6 Drawing Sheets

(56) References Cited

U.S. PATENT DOCUMENTS 1,142,698 A 6/1915 Grove et al.
1,185,617 A 6/1916 Blaha et al.
1,190,227 A 7/1916 Fesler
1,242,956 A 10/1917 Lewyt
1,261,502 A 4/1918 Farrows
1,355,026 A 10/1920 Austin
1,429,823 A * 9/1922 Allison ..... 132/103
1,457,615 A 6/1923 Bunker
1,480,814 A 1/1924 Bright et al.
1,486,957 A 3/1924 England
1,501,835 A 7/1924 Bash
1,508,306 A 9/1924 Strulson
1,510,898 A 10/1924 Nikicser
1,527,052 A 2/1925 McAndrews
1,563,031 A 11/1925 Jones
1,586,332 A 5/1926 Vinton
1,651,355 A 12/1927 Alland
1,666,116 A * 4/1928 Bunnell ..... A45D 40/26 132/216
1,748,491 A 2/1930 May
1,748,895 A 2/1930 Jordan
1,831,393 A 11/1931 Pierce, Jr.
1,864,874 A 6/1932 Voight
1,889,496 A 11/1932 Priest
1,899,242 A 2/1933 Mcnab
1,914,240 A 6/1933 Caldwell
1,938,442 A 12/1933 Stuart
1,972,532 A 9/1934 McMillan
2,104,651 A 1/1938 Hoffman, Jr.
2,132,943 A 10/1938 Frazier
2,141,531 A 12/1938 Graham
2,199,154 A 4/1940 Frohnert
2,262,753 A 11/1941 Brennan
D134,797 S 1/1943 Lubkin
2,442,051 A 5/1948 Luscri
2,485,822 A 10/1949 Goldrich
2,533,838 A 12/1950 Ranft
D165,691 S 1/1952 Macomic
2,584,735 A 2/1952 Pancoast
2,590,329 A 3/1952 Kromray
2,591,537 A 4/1952 Gordon
2,622,256 A 12/1952 Vojacek
2,637,060 A 5/1953 Cowan
2,637,868 A 5/1953 Hamilton
2,642,331 A 6/1953 Sprinkle
2,701,378 A 2/1955 Reinbolt et al.
2,736,051 A 2/1956 Boodakian
2,797,886 A 7/1957 Pinckney
2,874,399 A 2/1959 Solomon
2,946,072 A 7/1960 Filler et al.
2,982,983 A 5/1961 Peterson
2,997,210 A 8/1961 Mackirdy
3,007,188 A 11/1961 Dolan
3,106,738 A 10/1963 Bohne
3,170,265 A 2/1965 Goldfarb
3,193,863 A 7/1965 Myers et al.
3,205,523 A 9/1965 Seaver
D205,127 S 6/1966 Dykes
3,291,130 A 12/1966 Whitehead
3,309,728 A 3/1967 Seaver
3,353,203 A 11/1967 Ginter
3,472,242 A 10/1969 Demner
3,495,858 A 2/1970 Kindel
3,505,700 A 4/1970 Rodriguez
3,531,814 A 10/1970 Safalow
3,577,582 A 5/1971 Aston
3,592,202 A 7/1971 Jones
3,712,749 A 1/1973 Roberts
3,867,299 A 2/1975 Rohatgi et al.
3,884,635 A 5/1975 Sloan et al.
3,908,676 A 9/1975 Levine et al.
3,951,157 A 4/1976 Idec
3,955,670 A 5/1976 Buslik et al.
4,088,413 A 5/1978 Rossignol de la Ronde et al.
D249,600 S 9/1978 Bowman
4,129,918 A 12/1978 Lee et al.
D251,159 S 2/1979 Tolliver
4,140,222 A 2/1979 Francavilla
4,165,942 A 8/1979 Johansson
4,187,607 A 2/1980 Simuro et al.
4,203,431 A 5/1980 Abura
4,204,294 A 5/1980 Halverson
4,213,472 A 7/1980 Gueret et al.
D258,241 S 2/1981 Takada et al.
4,248,543 A 2/1981 Carrington et al.
4,267,851 A 5/1981 Plaisted
4,292,986 A 10/1981 Ergaver et al.
4,381,159 A 4/1983 Payne
D269,481 S 6/1983 Souza
4,396,238 A 8/1983 Torruella et al.
4,479,047 A 10/1984 Khaja et al.
4,483,036 A 11/1984 Sayklay
4,502,497 A 3/1985 Siahou et al.
D278,951 S 5/1985 Kalinsky
4,545,393 A 10/1985 Gueret et al.
4,600,328 A 7/1986 Clements
4,617,948 A * 10/1986 Gueret ..... A45D 40/267 132/218
4,681,791 A 7/1987 Shibahashi et al.
4,727,618 A 3/1988 Mahoney et al.
4,734,953 A 4/1988 Dodson
D296,005 S 5/1988 Alkire
D297,889 S 10/1988 Ries et al.
4,776,456 A 10/1988 Lewis
4,778,300 A 10/1988 French et al.
4,869,612 A 9/1989 Mooney et al.
4,898,193 A 2/1990 Gueret et al.
4,917,132 A * 4/1990 Tuchman ..... 132/316
4,929,108 A 5/1990 Gueret
D311,455 S 10/1990 Snipes
4,987,911 A 1/1991 Powers
5,007,442 A 4/1991 Hirzel et al.
5,052,839 A 10/1991 Pettengill
5,056,179 A 10/1991 Capponi
D325,264 S 4/1992 Shinohara
5,107,984 A 4/1992 Welschoff
5,109,877 A 5/1992 Takeda
D328,366 S 7/1992 Villani
5,134,747 A 8/1992 Roesler et al.
5,137,038 A 8/1992 Kingsford
5,153,066 A 10/1992 Tanaka et al.
5,176,754 A 1/1993 Hirzel
5,211,494 A 5/1993 Baijnath et al.
5,220,702 A 6/1993 Howell et al.
D339,235 S * 9/1993 Hirzel ..... D4/116
5,301,695 A 4/1994 Wong
5,316,513 A 5/1994 Nakagawa et al.
5,330,056 A 7/1994 De La Rocha
5,333,343 A 8/1994 Nichols et al.
5,334,421 A 8/1994 McNutt
5,339,483 A 8/1994 Byun et al.
5,348,031 A 9/1994 Cloud
5,388,599 A 2/1995 Yen et al.
5,431,176 A 7/1995 Favre et al.
5,447,167 A 9/1995 Fleischaker
5,480,027 A 1/1996 Leonard
5,480,038 A 1/1996 Collier
5,482,059 A 1/1996 Miraglia
5,484,065 A 1/1996 Davoli
5,491,865 A 2/1996 Gueret
5,507,063 A 4/1996 Hirsch
5,535,474 A 7/1996 Salazar
5,573,019 A 11/1996 Hempel
5,588,447 A 12/1996 Gueret
D377,121 S 1/1997 Lee
5,596,785 A 1/1997 Park
5,603,340 A 2/1997 Gueret
5,617,884 A 4/1997 Allison
5,620,270 A 4/1997 Gueret
5,628,082 A 5/1997 Moskovich et al.
5,630,505 A 5/1997 Garcia
D380,615 S 7/1997 Roberts
5,713,471 A 2/1998 Gueret
5,765,252 A 6/1998 Carr

(56) References Cited

U.S. PATENT DOCUMENTS 5,778,479 A 7/1998 Raia
5,799,910 A 9/1998 Dexter et al.
5,802,658 A 9/1998 Ward
5,839,626 A 11/1998 Gross et al.
5,881,742 A 3/1999 Hunsberger
D408,636 S 4/1999 Gadling
5,896,614 A 4/1999 Flewitt et al.
5,896,866 A 4/1999 Quennessen
5,941,254 A * 8/1999 Heler ..... 132/297
5,957,604 A 9/1999 Anderson
5,960,745 A 10/1999 Boyland
5,960,802 A 10/1999 Sakai
5,970,989 A 10/1999 Litton
5,974,618 A 11/1999 Dumler et al.
5,976,616 A 11/1999 Celia
6,024,101 A 2/2000 Garner et al.
6,026,824 A 2/2000 Gueret
D421,846 S 3/2000 Choe
6,039,051 A 3/2000 Dorf
D422,916 S 4/2000 Herrmann
6,070,597 A 6/2000 Motherhead
6,070,749 A 6/2000 Joulia
6,074,076 A 6/2000 Parrish
6,119,891 A 9/2000 Favre
6,138,686 A 10/2000 Yuhara
6,145,151 A 11/2000 Herron et al.
6,158,443 A * 12/2000 Leman et al. ..... 132/120
6,173,719 B1 1/2001 Petit
6,180,741 B1 1/2001 Yamaguchi et al.
6,186,324 B1 2/2001 Catterson
6,189,697 B1 2/2001 Davis
D439,415 S 3/2001 Mink et al.
6,199,694 B1 3/2001 Van Diest et al.
6,202,242 B1 3/2001 Salmon et al.
6,202,902 B1 3/2001 Starr
6,224,287 B1 5/2001 Gieux
6,234,181 B1 5/2001 Lou
6,241,203 B1 6/2001 Cukrov
6,254,996 B1 7/2001 Fukuda et al.
6,264,147 B1 7/2001 Mitchell
6,268,040 B1 7/2001 McArthur
6,269,515 B1 8/2001 Varma
D448,178 S 9/2001 Tapley et al.
6,283,298 B1 9/2001 Seidler
6,298,863 B1 10/2001 Byun
6,309,124 B1 10/2001 Gueret
D450,189 S 11/2001 Mink et al.
D450,930 S 11/2001 Mink et al.
D450,931 S 11/2001 Mink et al.
6,311,358 B1 11/2001 Soetewey et al.
6,312,182 B1 11/2001 Dumler
D451,681 S 12/2001 Mink et al.
6,336,460 B2 1/2002 Yuhara
6,342,167 B1 1/2002 Kawano et al.
D454,001 S 3/2002 Mink et al.
6,354,308 B1 3/2002 Kuk
6,357,944 B1 3/2002 Reed et al.
6,371,420 B1 4/2002 Strunk
D458,134 S 6/2002 Berish et al.
6,401,290 B1 6/2002 Barton et al.
6,405,402 B1 6/2002 Choi
6,418,939 B1 7/2002 Byun
6,438,784 B1 8/2002 Yu
6,497,236 B1 12/2002 Yates et al.
6,505,402 B2 1/2003 Moriwake et al.
6,506,327 B2 1/2003 Weihrauch
D471,018 S 3/2003 Mink
6,532,970 B2 3/2003 Phue
D472,462 S 4/2003 Atkin et al.
6,546,937 B2 4/2003 Gueret
D474,342 S 5/2003 Silvestri
D475,536 S 6/2003 Vaes
6,588,958 B1 7/2003 Seidler
6,596,203 B1 7/2003 Au et al.
6,601,591 B1 8/2003 Carullo et al.
D479,917 S 9/2003 Mink
D479,918 S 9/2003 Mink
D480,218 S 10/2003 Mink
6,669,389 B2 12/2003 Gueret
D485,442 S 1/2004 Twigg
6,706,775 B2 3/2004 Hermann et al.
6,712,076 B2 3/2004 Alexander et al.
6,761,969 B2 7/2004 Li et al.
6,831,541 B1 12/2004 Seidler
6,832,405 B1 12/2004 Miller
6,866,046 B2 3/2005 Gueret
6,880,197 B2 4/2005 Katz et al.
6,890,115 B2 5/2005 Le Moing
6,895,628 B1 5/2005 Anderson
6,898,818 B2 5/2005 Lin
6,942,412 B2 9/2005 Gueret
6,957,468 B2 10/2005 Driesen et al.
7,004,913 B1 2/2006 Rutenberg et al.
7,007,797 B1 3/2006 Ruccolo
7,073,902 B2 7/2006 Codos et al.
7,096,598 B1 8/2006 Myatt
D527,529 S 9/2006 Ajluni et al.
D528,305 S 9/2006 Langer
7,107,645 B2 9/2006 Bressler et al.
7,111,354 B2 9/2006 Nennig et al.
D529,292 S 10/2006 Langer
7,127,770 B2 10/2006 Clegg et al.
7,140,061 B2 11/2006 Baker et al.
7,159,950 B2 1/2007 Young-Chul
7,228,864 B2 6/2007 Tahara
7,234,474 B2 6/2007 Byun
7,246,400 B2 7/2007 Ryan
7,261,483 B2 8/2007 Gueret
D549,964 S 9/2007 Roth et al.
D550,562 S 9/2007 Yew
D551,569 S 9/2007 Tanaka
7,275,885 B2 10/2007 Byun
7,316,045 B2 1/2008 Koke
D562,005 S 2/2008 King
D562,566 S 2/2008 Mink
7,334,685 B2 2/2008 Mathiez
7,337,787 B2 3/2008 Matsuoka
7,344,327 B2 3/2008 Gueret
D566,969 S 4/2008 Sherman et al.
D568,050 S 5/2008 Huang
D568,740 S 5/2008 Williams
D571,105 S 6/2008 Godin
D572,585 S 7/2008 Perrin et al.
7,416,358 B2 8/2008 Legendre
D577,911 S 10/2008 Liebers
D578,773 S 10/2008 Sherman et al.
D580,177 S 11/2008 Louis-Jeune
7,448,111 B2 11/2008 Bigio
7,465,113 B2 12/2008 Gueret
D584,513 S 1/2009 Sherman et al.
D584,897 S 1/2009 Belley
7,494,030 B2 2/2009 Bennett
D589,665 S 3/2009 Kwapis
7,530,752 B2 5/2009 Gueret
D598,655 S 8/2009 Thorpe et al.
7,581,544 B2 9/2009 Gueret
D601,803 S 10/2009 Reishus et al.
D601,804 S 10/2009 Hwang
7,653,960 B2 2/2010 Lee
D612,615 S 3/2010 Chitayat et al.
7,716,775 B2 5/2010 DiPietro et al.
D616,743 S 6/2010 Cresswell et al.
D616,744 S 6/2010 Cresswell et al.
7,727,634 B2 6/2010 Yacovone
D620,798 S 8/2010 Cresswell et al.
D621,258 S 8/2010 Gullickson et al.
7,766,440 B2 8/2010 Kusunoki
D623,371 S 9/2010 Li
D626,338 S 11/2010 Ajootian
7,824,124 B2 11/2010 Francavilla et al.
7,832,564 B2 11/2010 Kim
7,854,562 B2 12/2010 Peterson et al.
7,866,758 B2 1/2011 Jang
D632,488 S 2/2011 Twigg

(56) References Cited

U.S. PATENT DOCUMENTS 7,882,949 B1 2/2011 Singh
7,895,696 B2 3/2011 Belmonte
7,895,698 B2 3/2011 Mink
7,918,620 B2 4/2011 Del Ponte
D637,404 S 5/2011 Wang
7,950,402 B1 5/2011 Cole
7,955,014 B2 6/2011 Thorpe et al.
7,996,947 B2 8/2011 Gueret
D646,487 S 10/2011 Leppla et al.
8,032,972 B2 10/2011 Cherry
8,061,518 B2 11/2011 Shaughness
8,074,666 B2 12/2011 Piao
8,074,796 B1 12/2011 Andrews
D651,409 S 1/2012 Papenfu
8,104,132 B2 1/2012 Mink
D654,375 S 2/2012 Kuboshima
8,117,707 B1 2/2012 Ruh, II
8,132,285 B2 3/2012 Piao
8,132,541 B1 3/2012 Baer, Jr.
8,136,536 B2 3/2012 Bickford
8,141,561 B2 3/2012 Thorpe et al.
D658,385 S 5/2012 Lim et al.
D658,389 S 5/2012 Salgatar
8,184,998 B2 5/2012 Morikuni
8,185,993 B2 5/2012 Fischer et al.
8,185,998 B2 5/2012 Xu
8,220,100 B2 7/2012 Diamond
8,220,469 B1 7/2012 Spagnuolo
8,226,319 B2 7/2012 Francavilla et al.
8,230,543 B2 7/2012 Shrier et al.
8,256,058 B2 9/2012 Telwar
D669,213 S 10/2012 Celia
8,286,790 B1 10/2012 McBryar
8,292,529 B2 10/2012 Francavilla
8,321,987 B2 12/2012 Bagley
8,360,078 B2 1/2013 Lim et al.
D675,829 S 2/2013 Jakubow
8,371,549 B1 2/2013 Paquette
8,393,037 B2 3/2013 Iwahori et al.
8,402,592 B2 3/2013 Byrne et al.
D681,342 S 5/2013 Brower
8,522,973 B2 9/2013 Joseph
8,595,886 B2 12/2013 Edelstein et al.
8,657,107 B2 2/2014 Gabbard
8,678,693 B2 3/2014 Sturgis et al.
D707,390 S 6/2014 Bunkley
8,752,559 B1 6/2014 Tsai
D717,548 S 11/2014 Lim
D727,034 S 4/2015 Lewis
D727,567 S 4/2015 Bunkley
2001/0003600 A1 6/2001 Guay
2002/0040720 A1 4/2002 Byun
2002/0078902 A1 6/2002 Ehrmann
2002/0148058 A1 10/2002 Greenwood et al.
2002/0162565 A1 11/2002 Sebban
2002/0164192 A1 11/2002 Gueret
2003/0005533 A1 1/2003 Woodnorth et al.
2003/0035953 A1 2/2003 Weihrauch
2003/0066151 A1 4/2003 Chang
2003/0089673 A1 5/2003 Herren
2003/0110585 A1 6/2003 Rechelbacher
2003/0135945 A1 7/2003 Nordstrom
2004/0050732 A1 3/2004 Baker
2004/0129580 A1 7/2004 Cochran
2004/0134009 A1 7/2004 Sander et al.
2004/0163193 A1 8/2004 Stafford
2004/0237996 A1 12/2004 Fischer
2005/0011030 A1 1/2005 Gonzalez
2005/0138747 A1 6/2005 Su et al.
2005/0198759 A1 9/2005 Segrea
2005/0249539 A1 11/2005 Habatjou
2005/0273962 A1 12/2005 Dillon
2006/0000729 A1 1/2006 Ceballos
2006/0075570 A1 4/2006 Gelfand
2006/0150355 A1 7/2006 Mason et al.
2006/0162736 A1 7/2006 Gray
2006/0223024 A1 10/2006 Hochman
2006/0260078 A1 11/2006 Ranks
2007/0080094 A1 4/2007 Moon
2007/0113364 A1 5/2007 Zen
2007/0124882 A1 6/2007 Lee
2007/0151061 A1 7/2007 Mink et al.
2007/0151571 A1 7/2007 Byun
2007/0206986 A1 9/2007 Gueret
2007/0261710 A1 11/2007 Son et al.
2007/0295351 A1 12/2007 Germer
2008/0060665 A1 3/2008 Umeno et al.
2008/0078419 A1 4/2008 Hirst
2008/0213719 A1 9/2008 Giniger et al.
2008/0243179 A1* 10/2008 Ziv ..... 606/211
2008/0256725 A1 10/2008 Emge
2008/0256733 A1 10/2008 Brown
2008/0276396 A1 11/2008 Lucero
2008/0309017 A1 12/2008 Mattice
2009/0003917 A1 1/2009 Duncan
2009/0039995 A1 2/2009 Kipp et al.
2009/0044357 A1 2/2009 Chan et al.
2009/0054925 A1* 2/2009 Cho ..... 606/210
2009/0071499 A1 3/2009 Wyatt et al.
2009/0071502 A1 3/2009 Drugeon
2009/0089949 A1 4/2009 Mink et al.
2009/0090375 A1 4/2009 Tran
2009/0097899 A1 4/2009 Carroll
2009/0119863 A1 5/2009 Gallegos
2009/0131977 A1* 5/2009 Ross ..... 606/211
2009/0183328 A1 7/2009 King
2009/0194127 A1 8/2009 Pires et al.
2009/0194129 A1 8/2009 Junemann
2009/0200184 A1 8/2009 Cullen
2009/0211939 A1* 8/2009 Cho ..... 206/581
2009/0260172 A1 10/2009 Weiss
2009/0272399 A1 11/2009 Kim
2010/0001541 A1* 1/2010 Sugiyama ..... 294/99.2
2010/0017990 A1 1/2010 Piao
2010/0037407 A1 2/2010 Telwar
2010/0043815 A1 2/2010 Levy et al.
2010/0059080 A1 3/2010 Gueret
2010/0095973 A1 4/2010 Shrier et al.
2010/0163071 A1 7/2010 Everett, Jr. et al.
2010/0324594 A1* 12/2010 Mercanti ..... 606/211
2011/0056505 A1 3/2011 Parkinson et al.
2011/0083690 A1 4/2011 Cardenas et al.
2011/0116857 A1 5/2011 Carroll et al.
2011/0174823 A1 7/2011 Silva
2011/0198453 A1 8/2011 Volk
2011/0198454 A1 8/2011 Volk
2011/0266297 A1 11/2011 Thorpe et al.
2011/0315161 A1 12/2011 Lim et al.
2012/0017930 A1 1/2012 Nance
2012/0054971 A1 3/2012 Dugan
2012/0159731 A1 6/2012 Liu et al.
2012/0204899 A1 8/2012 Uehara et al.
2012/0260931 A1 10/2012 Martin et al.
2012/0272982 A1 11/2012 Telwar et al.
2012/0294666 A1* 11/2012 Jang ..... 401/126
2012/0295216 A1 11/2012 Dykes et al.
2012/0312315 A1 12/2012 Gueret
2013/0017010 A1 1/2013 Liu
2013/0111683 A1 5/2013 Lim et al.
2013/0199556 A1* 8/2013 Lim ..... 132/148
2014/0014659 A1 1/2014 Thorpe et al.
2014/0023689 A1 1/2014 Kim et al.
2014/0154295 A1 6/2014 Sim et al.
2014/0219701 A1 8/2014 Eberlein
2014/0259489 A1 9/2014 Dale
2014/0325775 A1 11/2014 Nakamura et al.
2014/0331422 A1 11/2014 Lim
2014/0332027 A1 11/2014 Lim

FOREIGN PATENT DOCUMENTS

CN 201308219 Y 9/2009
CN 201399985 Y 2/2010
CN 301313366 S 8/2010

(56) References Cited

FOREIGN PATENT DOCUMENTS

| | | | |
|---|---|---|---|
| CN | 201610006 | U | 10/2010 |
| CN | 101884463 | A | 11/2010 |
| CN | 301542018 | S | 5/2011 |
| CN | 202588745 | U | 12/2012 |
| CN | 302457092 | S | 6/2013 |
| DE | 2111893 | A1 | 9/1972 |
| DE | 3232227 | A1 | 3/1984 |
| DE | 4215896 | C1 | 11/1993 |
| DE | 29713124 | U1 | 9/1997 |
| DE | 29807245 | U1 | 6/1998 |
| DE | 10038850 | A1 | 2/2002 |
| EP | 2084986 | A2 | 8/2009 |
| EP | 2301379 | A1 | 3/2011 |
| EP | 2526814 | A1 | 11/2012 |
| FR | 2464674 | A | 3/1981 |
| FR | 2642283 | A1 | 8/1990 |
| FR | 2976463 | A | 12/2012 |
| JP | 2003033228 | A | 2/2003 |
| JP | 2003135140 | A | 5/2003 |
| JP | 2004041260 | A | 2/2004 |
| JP | 1218834 | S | 10/2004 |
| JP | 2007068945 | A | 3/2007 |
| JP | 1343552 | S | 11/2008 |
| JP | 2009172300 | A | 8/2009 |
| KR | 200262437 | A | 3/2002 |
| KR | 300365471 | S | 10/2004 |
| KR | 300404554 | S | 1/2006 |
| KR | 200432010 | Y1 | 11/2006 |
| KR | 300525977 | S | 9/2008 |
| KR | 30-0607863 | S | 8/2011 |
| KR | 30-0672266 | S | 3/2012 |
| KR | 30-0681633 | S | 11/2012 |
| WO | 9211785 | A1 | 7/1992 |
| WO | 2007117091 | A1 | 10/2007 |
| WO | 2008117275 | A1 | 10/2008 |
| WO | 2009031851 | A2 | 3/2009 |
| WO | 2010098997 | A1 | 9/2010 |

OTHER PUBLICATIONS

Ebay: L'Oreal Brow Stylist Professional 3-in-1 brow tool; retrived on Jun. 27, 2013 at: http://www.ebay.com/itm/LorealBrow-Stylist-3-in-1-Tool-Tweezer-Pencil-Brush-/360388299897; 3 pages.

European Search Report dated Apr. 6, 2017 for International Application No. 14838431.6.

The PCT Search Report and Written Opinion dated Nov. 20, 2014 for PCT application No. PCT/US2014/051606, 13 pages.

"All for One, Full Magnetic Travel Brush Set", Sephora, retrieved on Feb. 26, 2015 at <<http://www.sephora.com/aa-for-one-full-magnetic-travel-brush-set-P387815>>, 3 pages.

Benjabelle, "Mini Brush Tree" retrieved on Sep. 1, 2014 at <http://www.benjabelle.com/collections/brush-trees/product/mini-brush-tree>>, 3 pages.

"Brushegg", retrieved on Oct. 23, 2014 at <<http://brushegg.bigcartel.com/product/brushegg>>, 2 pages.

"Brush Cleaning Glove", Sigma Spa, retrieved on Oct. 16, 2014 at <<http://www.sigmabeauty.com/Sigma_Spa_Brush_Cleaning_Glove_p/bc001.htm>>, 2 pages.

"Car Wash Brushes," Martin Cox Chamois Ltd, retrieved on Oct. 16, 2014 at <<http://www.martincoxchamois.com/flow_through_car_wash_brushes.html>>, 8 pages.

"Clarisonic" retrieved on Dec. 19, 2013 at <<http://www.clarisonic.com/>> 5 pages.

CN 3412782 Registered Design, (Tianjin Samsung Brushes Ltd.) Dec. 22, 2004 [online], [retrieved on Oct. 3, 2014] Retrieved from the Questel Intellectual Property Portal Design Database Using the Internet: <URL; http://www.orbit.com>.

CN 3412783 Registered Design, (Tianjin Samsung Brushes Ltd.) Dec. 22, 2004 [online], [retrieved on Oct. 3, 2014] Retrieved from the Questel Intellectual Property Portal Design Database Using the Internet: <URL; http://www.orbit.com>.

CN 3412785 Registered Design, (Tianjin Samsun Brushes Ltd.) Dec. 22, 2004, [online], [retrieved on Oct. 3, 2014] Retrieved from the Questel Intellectual Property Portal Design Database using the Internet: <URL: http://www.orbit.com>.

CN 3417893 Registered Design, (Tianjin Samsun Brushes Ltd.) Jan. 12, 2005, [online], [retrieved on Oct. 3, 2014] Retrieved from the Questel Intellectual Property Portal Design Database using the Internet: <URL: http://www.orbit.com.>.

CN 3466155 Registered Design, (Tianjin Samsung Brushes Ltd.) Aug. 10, 2005 [online], [retrieved on Aug. 26, 2014] Retrieved from the Questel Intellectual Property Portal Design Database Using the Internet: <URL; http://www.orbit.com>.

Da Vinci Catalog, Novelties 2005-2008, © Jan. 2008 [online], Top-point Mix B series 5535 Brushes, [retrieved on Mar. 13, 2015]. Retrieved from the internet: <URL: http://www.davinci-defect.com>.

"Dual Interchangeable Brush Set", Global Market, retrieved on Mar. 18, 2015 at <<http://www.glabalmarket.com/product-info/dual-interchangeable-brush-set-468011.html>>, 2 pages.

Everbluec Singapore Beauty Makeup and Skincare Blog, May 14, 2011 [online], Elizabeth Arden makeup blender, [retrieved on Mar. 14, 2015] Retrieved from the Internet: http://everbluec.com/2011/05/ceramide-colors-exclusive-launch-at.html>.

"Fingermax Creative Finger Painting Paint Brush", retrieved on Oct. 9, 2014 at „http://thesotre.com/fingermax-creative-finger-painting-paint-brush/TSHVY6X6YF>>, 5 Pages.

Foam Finger Wax Applicator, retrieved on Nov. 6, 2014 at <<http://www.cleanyourcar.co.uk/accessories/foam-tinger-waxapplicators-pkg/2/prod_633.html>>, 2 pages.

"Furbuster 3 in 1 Dog Grooming Glove", Petmate 89801, retrieved on Oct. 16, 2014 at <<Furbuster 2 in 1 Dog Grooming>>, 6 pages.

"Givenchy Demesure Audacious Lashes Mascara," May 17, 2011, retrieved from the internet at <<http://www.fashionizers.com/perfumes-makeup/givenchu-demesure-audacious-lashes-mascara/>> , 9 pages.

Givenchy Parfums Maquillage, Soins, Parfums, retrieved on May 14, 2010 at <<http://www.parfumsgivenchy.com/make_up/collections/2010_summer_collection/products_in_this_collection/le_prisme_yeux_island_camaieu_limited_edition/product_5_183_1128_214.html>> 1 page.

Givenchy Summer Makeup Collection 2010 Review and Swatches, retrived on May 14, 2010 at <<http://www.musingsofamuse.com/2010/04/givenchy-summer-makeup-collection-2010-review-and-swatches.html>> 20 pages.

Indeutsch May 2003 [online], Hobby & Craft Brushes, Series HCS: Squirrel Mop, p. 2, [retrieved on Jun. 30, 2014] Retrieved from the internet using Web Archive: URL:<http://web.archive.org/web/*/http://www.indeutsch.com>.

"iTech Magnetic & Tourmaline Boar and Nylon Bristle Brush 3 1/4 Inch", Beauty Encounter Inc.[retrieved on Sep. 9, 2010] <http://www.beautyencounter.com/727428765006.html>.

Lady Zona, "Choosing the Right Make Up Brush", Retrieved on Feb. 24, 2015 at <<http://www.ladyzona.com/choosing-the-right-make-up-brush/>>, 3 pages.

"Latest design double end kabuki blush brush", Alibaba.com, retrieved on Mar. 18, 2015 at << http://www.alibaba.com/product-detail/Latest-design-double-end-kabuki-blush_668701458.html>>, 3 pages.

"Launch Pad Mojo Magpro Professional Magnetic Brush Set", Beauty and the Blog, retrieved on Feb. 26, 2015 at <<http://www.beautyandblog.com/2012/01/launch-pad-mojo-magpro-professional.html>>, 4 pages.

LeKeux, "My Cosmetic Range "LeKeux HQ, retrieved on Feb. 24, 2015 at <<http://lekeuxhq.blogspot.com/2014/11/my-cosmetics-range.html>>, 6 Pages.

Little Blue Chairs, "My first Giveaway at Little Blue Chairs!" Retrieved on Apr. 10, 2013 at <<http://www.littlebluechairs.com/2011/02/my-first-giveaway-at-little-blue-chairs.html>> 8 pages.

"Makeup Brushes Buying Guide", Ebay, Jun. 9, 2014, retrieved on Mar. 18, 2015 at <<http://www.ebay.com/gds/Makeup-Brushes-Buying-Guide-/100000000177404992/g.html>>, 6 pages.

(56) References Cited

OTHER PUBLICATIONS

"MelodySusie", retrieved on Oct. 9, 2014 at <<http://amazon.com/MelodySusie-ApIlicatior-Milti-Functional-Vibration-Foundation/dp/B00B4QGM1A/ref=aag_m_pw_dpie=UTF8&m=A24IL96TV4XLBY>, 4 pages.
Moddea, retrieved on Oct. 16, 2014 at <<http://moddea.com/2012/10/>>, 15 pages.
Nixon, "Optometric Office", retrieved on Oct. 9, 2014 at <<http://www.optometricoffice.com?OO/OO-Archive/BIGGER-IS-BETTER-3436.aspx>>, 2 pages.
"Non Optional UK Beauty and Lifestyle Blog", posted by Nicola Surrey, retrieved on Jan. 9, 2015 at <<http://non-optional.blogspot.com/2012_08_01_archive.html>>, Aug. 2012 {2012}, Sephora classic Mineral Powder Brush, p. 16, 24 pages.
"Popcorn Yubi-fude Finger Brush", Japan Trend Shop, retrieved on Oct. 8, 2014 at <<http://www.japantrendshop.com/popcorn-yubifude-finger-brush-p-939.html>>, 3 pages.
"Series of innovations for makeup brushes", Premium Beauty Media, retrieved on Feb. 26, 2015 at <<http://www.premiumbeautynews.com/en/Series-of-innovations-for-make-up,3232>>, 2 pages.
"Silicone Blackhead Cleanser Nose Pore Brush Cleaner Remover Finger Tool", retrieved on Oct. 9, 2014 at <<Silicone Blackhead cleanser Nose Pore Brush cleaner Remover Finger Tool>>, 2 pages.
"Silicone Nose Pore Clean Finger Brush Blackhead Extractor Remover Facial Scrub Pad Tool", retrieved on Oct. 9, 2014 at <<http://www.alibaba.com/produckt-detail/Silicone-Nose_Pore-Clean-Finger-Brush_900763337.html>>.9 pages.
"Teeth Brushing for cats and dogs", retrieved on Oct. 9, 2014 at <<Teeth Brushing for cats and dogs>>, 7 pages.
The Brush Guard; http://www.thebrushguard.com/ retrieved Oct. 25, 2011, 1 page.
"The Makeup Bullet" retrieved on Oct. 9, 2014 at <<http://themakeupbullet.com/>>, 1 page.
Wholesale-mn-2 Pcs Portable Cosmetics Telescopic Lip, retrieved on Oct. 16, 2014 at <<http://www.dhgate.com/product/wholesale-mn-2-pcs-portable-cosmetics-telescopic/200881505.html#s1-2-1|2462569649>>, 7 pages.
"Why Didn't We Think of That: Magnetic Makeup Brush", Gloss Daily, retrieved on Feb. 26, 2015 at <<http://www.glossdaily.com/blogs/glossdaily/2012/05/31/magnetic-makeup-brush/>>, 2 pages.

* cited by examiner

COSMETIC SYSTEMS

BACKGROUND

Systems having tweezers disposed in a handle of a pencil exist for cosmetic purposes. For example, brow powder pencils exist that have an opening in an end of a handle of the brow powder pencil for housing tweezers.

While these systems may have tweezers housed in a handle of a brow pencil, the tweezers may be loosely housed in the handle, which make them susceptible to damage. For example, because the tweezers may be loosely housed in the handle, the tweezers may be allowed to move freely in the handle. Because the tweezers may be allowed to move freely in the handle, the tweezers may come in contact with an inside surface of the handle, which may cause damage to the pinching tip of the tweezers. In addition to the tweezers being loosely housed in the handle, the pinching tip of the tweezers may be housed in the handle in an open position. Because the pinching tip of the tweezers may be in an open position, the pinching tip is susceptible to damage. For example, because the pinching tips may be housed in the handle in an open position, the sharp edges of the pinching tips may become dull or less sharp from coming in contact with the inside surface of the handle.

Accordingly, there remains a need in the art for improved cosmetic systems that protect the pinching tips of tweezers until a time of use.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

This application describes two-in-one cosmetic systems having a tweezer removably disposed in a handle of the applicator such that when the tweezer is removably disposed in the handle, the tweezer is restrained and a pinching tip of the tweezer is in a closed position. By virtue of having the tweezer restrained and the pinching tip of the tweezer in the closed position when removably disposed in the handle, two-in-one cosmetic systems according to this disclosure are adaptable to keep the pinching tip sharp and undamaged until a time of use. For example, because the tweezer is restrained and the pinching tip of the tweezer in a closed position when removably disposed in the handle, the tweezer is prevented from being displaced and the cooperating edges of the pinching tip remain in contact with each other. Consequently, the cooperating edges do not come in contact with other surfaces when disposed in the handle, helping to keep the pinching tips sharp and undamaged until a time of use.

In one example, the two-in-one cosmetic system may comprise a tweezer having a pinching tip (i.e., the jaws of the tweezer), where when the tweezer is removably disposed in an cavity of a handle. The pinching tip is displaced from an open position to a closed position to keep cooperating edges of the pinching tip (i.e., sharp-edges arranged at the opening of the jaws of the tweezers) undamaged and sharp to provide a high level of precision while grooming a portion of a user's body.

In another example, the two-in-one cosmetic system may comprise an applicator fixed to a first end of a handle. When the tweezers are removably disposed in the handle, the pinching tip and a fulcrum of the tweezers and the applicator form a substantially straight line.

In various embodiments, the tweezers described herein may comprise lever arms connected to each other at an interior of a cap. The cap may removably couple with an open end of the handle and form at least a portion of the handle. The cap may provide a larger handle for the user to grasp then a traditional tweezer.

While the two-in-one cosmetic systems are described in various embodiments herein in the context of tweezer and brow brush systems for cosmetic grooming, the two-in-one cosmetic systems may also be used and adapted for other purposes. For example, the two-in-one cosmetic systems may be used and adapted for use in other cosmetic and/or grooming operations.

While the applicators are described in various embodiments herein as having a substantially flat rectangular shape, the applicators may be other shapes. For example, the applicator may be substantially cylindrical, tapered, conical, oval, flat-triangular, or the like.

Illustrative Two-in-One Cosmetic Systems

Figure 1:
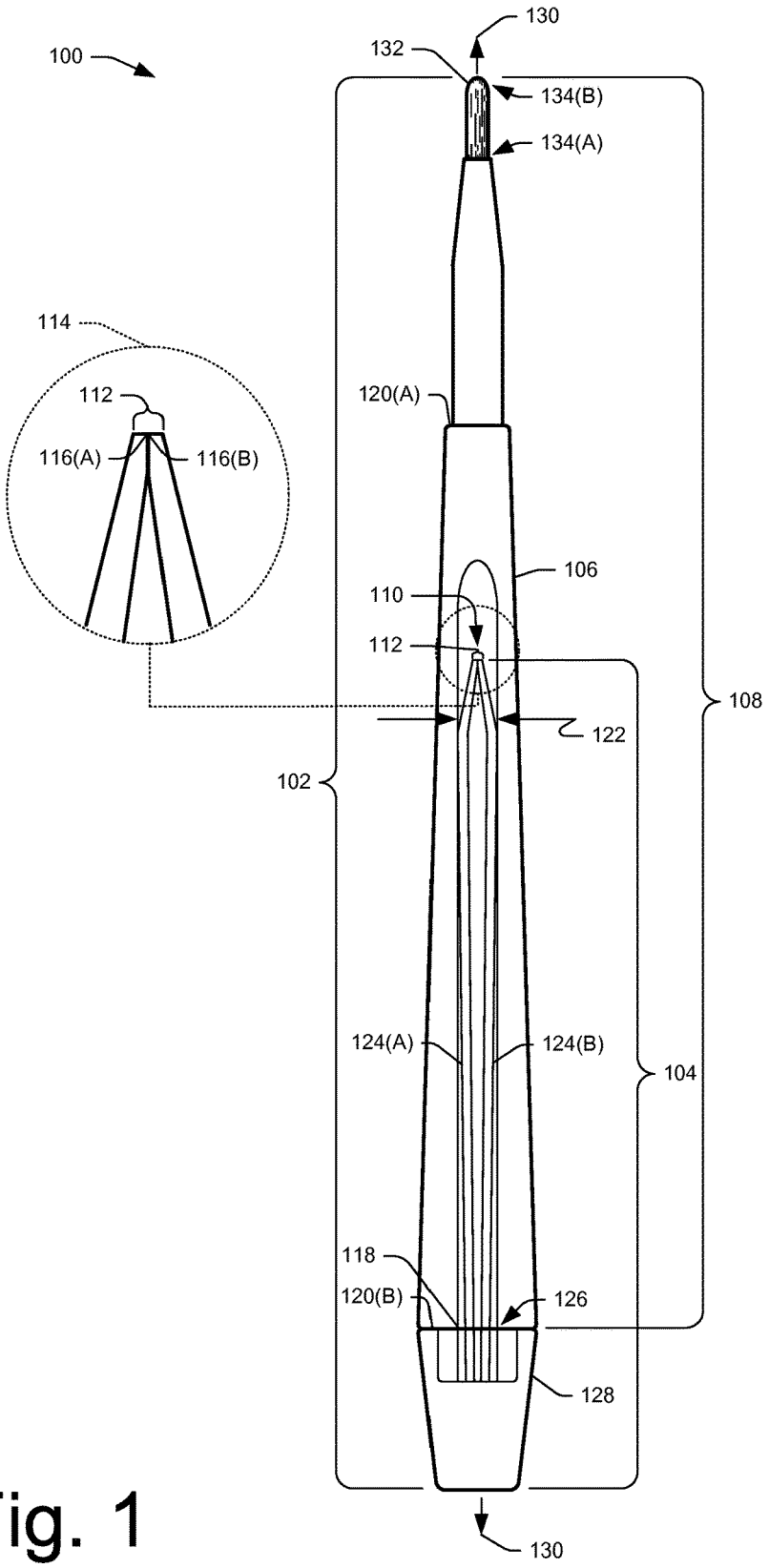
FIG. 1 depicts a front view of an illustrative two-in-one cosmetic system having tweezers removably disposed in a handle of a brush.

FIG. 1 depicts a front view 100 of an illustrative two-in-one cosmetic system 102 having a tweezer 104 removably disposed in a handle 106 of a brush 108, such that a pinching tip 110 of the tweezer 104 is in a closed position 112. The closed position 112 of the pinching tip 110 protects or shields the pinching tip 110, which keeps the pinching tip 110 undamaged and sharp. Detail view 114 illustrates the pinching tip 110 having cooperating edges 116(A) and 116(B) for grooming a portion of a body. When the tweezer 104 is removably disposed in the handle 106, the cooperating edges 116(A) and 116(B) substantially interface with each other. For example, the cooperating edges 116(A) and 116(B) may be in direct contact with each other. When the cooperating edges 116(A) and 116(B) are in direct contact with each other, the cooperating edges 116(A) and 116(B) are not exposed, and the cooperating edges 116(A) and 116(B) are shielded by the surrounding structure (e.g., front, top, bottom and/or side surfaces) of the pinching tip 110.

While the pinching tip 110 of the tweezer 104 is illustrated as having a flat pinching tip 110, the pinching tip 110 may be any other shape. For example, the pinching tip 110 may have a flat broad pinching tip, a flat blunt angled pinching tip, a flat broad angled pinching tip, a flat square pinching tip, a flat round pinching tip, a flat bent broad pinching tip, a blunt round pinching tip, a long needle pinching tip, a pointed pinching tip, or any other conventional tweezer pinching tip.

The handle 106 may include an cavity 118 for removably receiving the tweezer 104. For example, the brush 108 may be fixed to a first end 120(A) of the handle 106 opposite a second end 120(B), and the cavity 118 may be arranged in the second end 120(B) of the handle 106. The cavity 118 may extend from the second end 120(B) of the handle 106 towards the first end 120(A) of the handle 106. Moreover, the pinching tip 110 is held stationary and spaced from the interior walls of the cavity 118 in the handle 106, thereby preventing the pinching tip 110 from being damaged by contacting the sides and end of the cavity 118.

The cavity 118 may have an inside diameter 122 arranged to interface with the tweezer 104 when the tweezer 104 is removably disposed in the handle 106. For example, the tweezer 104 may have a pair of lever arms 124(A) and 124(B) extending from the pinching tip 110 to a fulcrum 126, and the inside diameter 122 may be arranged to interface with each of an outside surface of each lever arm 124(A) and 124(B) to displace the pinching tip 110 in to the closed position 112. Moreover, the inside diameter 122 may be arranged to interface with each lever arm 124(A) and 124(B), such that the inside diameter displaces each lever arm 124(A) and 124(B) a distance that is substantially the same as a distance between the cooperating edges 116(A) and 116(B) when the pinching tip 110 is in an open position. For example, when the tweezer 104 is inserted into the handle 106, the inside diameter 122 interferes with the lever arms 124(A) and 124(B) and displaces or squeezes the lever arms 124(A) and 124(B) towards each other until the cooperating edges 116(A) and 116(B) come in contact with each other. Moreover, the cavity 118 may have receiving features that cooperate with the outside surfaces of the lever arms 124(A) and 124(B) to hold the lever arms 124(A) and 124(B) in the handle 106. For example, the inside surface of the cavity 118 may include guides, grooves, rails, springs or the like that are arranged on the inside surface of the cavity 118 that cooperatively interface with the lever arms 124(A) and 124(B) to displace the pinching tip 110 in to the closed position 112 and to secure the lever arms 124(A) and 124(B) in the handle 106.

FIG. 1 illustrates a cap 128 may be fixed to the fulcrum 126 of the tweezer 104. The cap 128 may provide a bigger or better hand hold to remove the tweezer 104 and holding during use. The lever arms 124(A) and 124(B) may be connected to each other in an interior of the cap 128, forming the fulcrum 126 of the lever arms 124(A) and 124(B). For example, the lever arms 124(A) and 124(B) may be connected to each other via a weld and extend a distance into an interior of the cap 128. Alternatively, the lever arms 124(A) and 124(B) may be formed of a single unit of material connected to each other via a bend as a result of folding the single unit of material together and extend a distance into the interior of the cap 128.

FIG. 1 illustrates that when the tweezer 104 is removably disposed in the cavity 118, the cap 128 forms at least a portion of the handle 106. For example, when the tweezer 104 is removably disposed in the cavity 118 the cap 128 may removably couple with the second end 120(B) of the handle 106, such that an exterior profile of the cap 128 substantially matches an exterior profile of the handle 106. For example, the handle 106 may have a substantially cylindrical exterior profile that provides a first gripping surface, and the cap 128 may have substantially the same cylindrical exterior profile that provides a second gripping surface. Thus, when the cap 128 is removably coupled with the handle 106, the first and second gripping surfaces form a single gripping surface having a continuously smooth exterior profile.

The cap 128 may removably couple with the second end 120(B) of the handle 106 and seal the cavity 118. For example, the cap 128 may removably couple with the second end 120(B) of the handle 106 via a press fit, snap fit, interference fit, screw threads, bayonet fastener(s) etc. Moreover, when the cap 128 removably couples with the second end 120(B) of the handle 106, the cap 128 may structurally support or fix the tweezer 104 in the handle 106. For example, the cap 128 may fix the fulcrum 126 end of the tweezer 104 proximate to the second end 120(B) of the handle 106 such that the tweezer 104 is prevented from being displaced when housed in the handle 106. Because the cap 128 prevents the tweezer 104 from being displaced in the handle 106, the pinching tip 110 is prevented from coming in contact with an inside surface of the handle 106, keeping the pinching tip 110 undamaged.

The pair of lever arms 124(A) and 124(B) may or may not be connected to each other in an interior of the cap 128. For example, each of the lever arms 124(A) and 124(B) may be individually fixed to the cap 128 in the interior of the cap 128. For example, the pair of lever arms 124(A) and 124(B) may be fixed in the interior of the cap 128 via a compression fit, a press fit, or a snap fit. The cap 128 may be molded directly onto the pair of lever arms 124(A) and 124(B). For example, the cap 128 may provide sufficient force on the lever arms 124(A) and 124(B) to compress the pair of lever arms 124(A) and 124(B) together, forming the fulcrum 126. Additionally or alternatively, the pair of lever arms 124(A) and 124(B) may be fixed in the interior of the cap 128 via an adhesive or a fastener, forming the fulcrum 126. The handle 106, the lever arms 124(A) and 124(B), and/or the cap 128 may be formed of metal, plastic, composite, and/or wood. In one specific example, the pair of lever arms 124(A) and 124(B) may be formed of spring steel.

FIG. 1 depicts the two-in-one cosmetic system 102 having the tweezer 104 removably disposed in the handle 106 arranged substantially straight along a linear axis 130, such that an applicator 132 is substantially parallel and directly in line with the tweezer 104 and the brush 108, which are arranged with a centroid of the removably coupled tweezer 104 and the brush 108 along the same linear axis 130. More specifically, the applicator 132 may have a first end 134(A) fixed to the first end 120(A) of the handle 106 and a second end 134(B) distal to the first end 134(A), and when the tweezer 104 is removably disposed in the cavity 118, the pinching tip 110, the fulcrum 126, and the second end 134(B) of the applicator 132 are arranged along the same linear axis 130. Stated otherwise, when the tweezer 104 is removably disposed in the cavity 118 arranged in the second end 120(B) of the handle 106, the pinching tip 110 and the fulcrum 126 of the tweezer 104 and the second end 134(B) of the applicator 132 form a substantially straight line such that the second end 134(B) of the applicator 132 extends substantially opposite the fulcrum 126 along the straight line. A cap may removably couple to the brush 108 to cover and protect the applicator 132.

Because the applicator 132 is arranged substantially straight along the linear axis 130 and in line with the tweezer 104 removably disposed in the handle 106, a user may wield the applicator 132 with precision. For example, because the applicator 132, the handle 106, and the tweezer 104 are in line with each other, a user may grip the handle 106 and groom a portion of the body at a generally perpendicular orientation (i.e., much like holding a writing utensil). For example, a user may grip the handle 106 and groom the eyebrows where the linear axis 130 of the two-in-one cosmetic system 102 is at a generally perpendicular orientation to the user's face rather than at a generally horizontal orientation to the user's face. The generally perpendicular orientation may range from at least about 30 degrees to at most about 120 degrees relative to a users face, which provides for accurate grooming of a user's eyebrows. For example, a user may wield the two-in-one cosmetic system 102 at a generally perpendicular orientation to groom the eyebrows by following the arch of the eyebrow with small, feather-like strokes.

Figure 2:
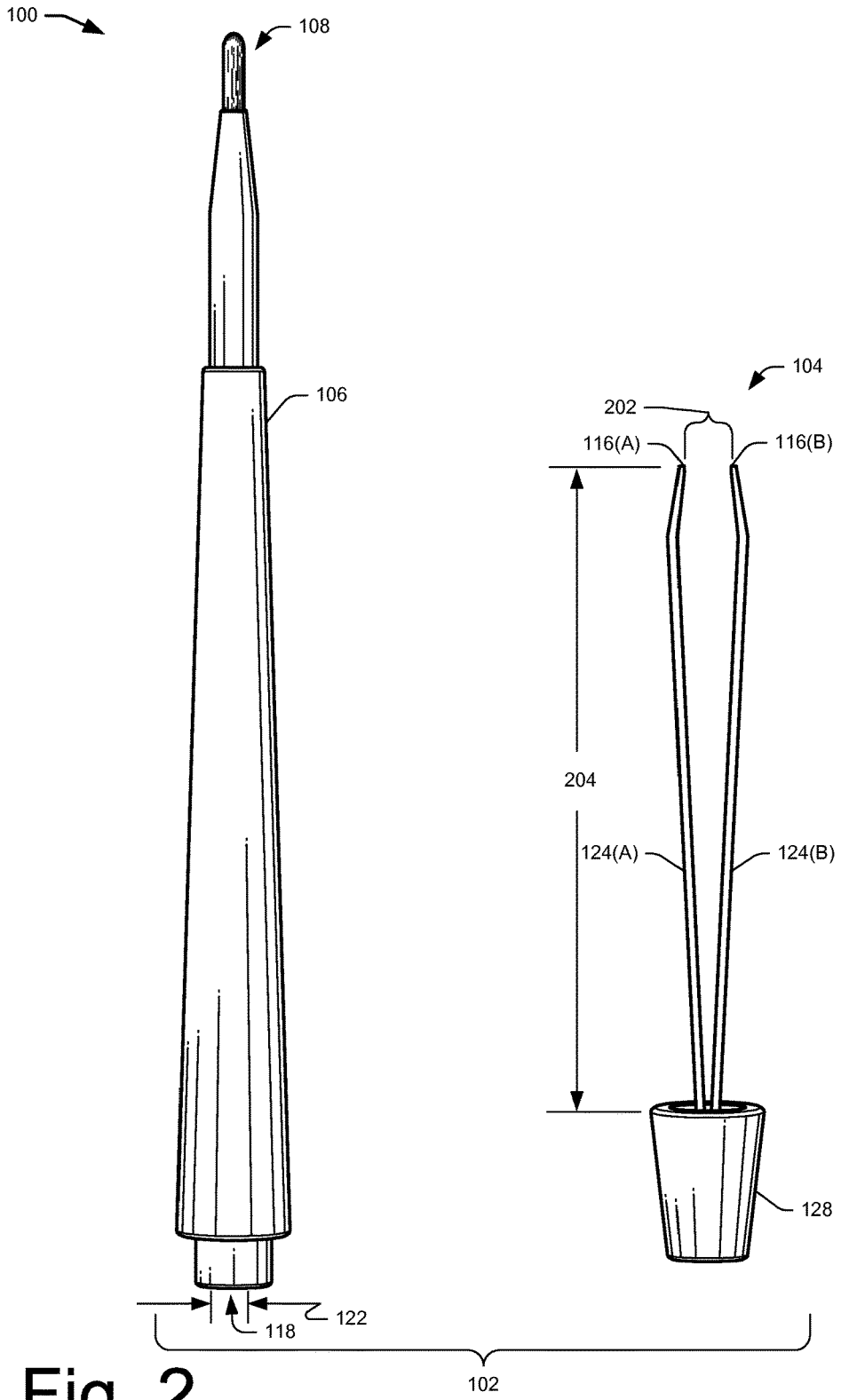
FIG. 2 depicts the front view of the illustrative two-in-one cosmetic system of FIG. 1 with the tweezers removed from the handle of the brush.

FIG. 2 depicts the front view of the illustrative two-in-one cosmetic system 102 of FIG. 1 with the tweezer 104 removed from the handle 106 of the brush 108, such that the pinching tip 110 of the tweezer 104 is in an open position 202. When the pinching tip 110 of the tweezer 104 is in the open position 202, the cooperating edges 116(A) and 116(B) may be separated by a distance. For example, the cooperating edges 116(A) and 116(B) may be separated by a distance of at least about 0.1 inches (2.5 millimeters) and up to at most about 1 inch (25 millimeters). The cap 128 may be separated a distance 204 from the pinching tip 110. The distance 204 may be at least about 2 inches (51 millimeters) and up to at most about 7 inches (178 millimeters).

While the two-in-one cosmetic system 102 is illustrated as having a tweezer 104 removably disposed in the handle 106 of the brush 108, other implements are contemplated that may be removably disposed in the handle 106 of the brush 108. For example implements including lipstick, eyeliner, mascara, eyeshadow, nail polish or the like may be removably disposed in the handle 106 of the brush 108. By way of example and not limitation, several alternative implements are shown in FIGS. 3A and 3B.

Figure 3A:
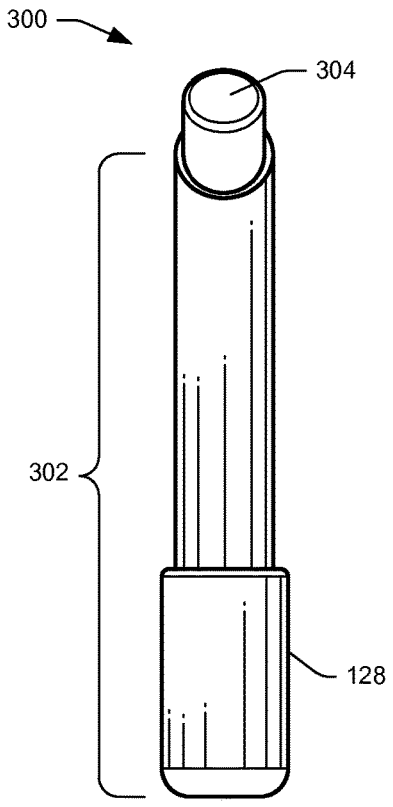
FIG. 3A and FIG. 3B each depict front views of example implements that may be used with the two-in-one cosmetic system of FIG. 1, each implement having a different use. For instance, the implements of FIGS. 3A and 3B may be inserted in a cavity of an applicator, such as the brush of FIG. 1 or other applicator.

FIG. 3A depicts a front view 300 of a tube 302 for applying a lipstick 304 to a portion of the body. The tube 302 may include the cap 128, such that when the tube 302 is removably disposed in the handle 106 of the brush 108, the cap 128 may structurally support or fix the tube 302 in the handle 106. In this embodiment, where the implement comprises the tube 302 for applying the lipstick 304 to a portion of the body, the applicator 132 fixed to the first end 120(A) of the handle 106 may comprise a lip brush. For example, the applicator 132 may comprise a brush arranged to provide precise application of the lipstick 304 or a gloss. For example, the applicator 132 may comprise a brush having a cone shaped group of bristles arranged to be swirled onto the lipstick 304 or dipped into a gloss and used to apply a precise lip line, fill, and/or blend the lipstick 304 and/or the gloss to a user's lips.

Figure 3B:
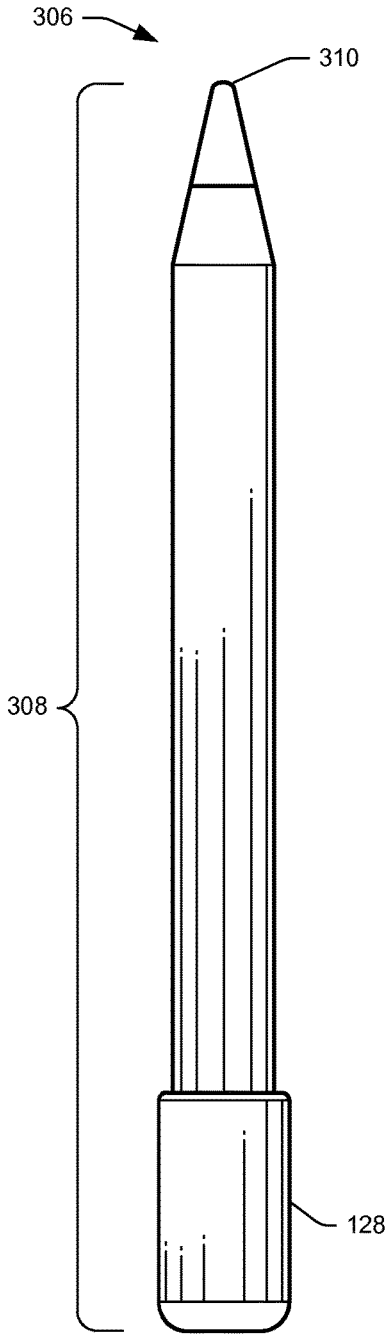

FIG. 3B depicts a front view 306 of a pencil 308 for applying an eyeliner 310 to a portion of the body. The pencil 308 may include the cap 128, such that when the pencil 308 is removably disposed in the handle 106 of the brush 108, the cap 128 may structurally support or fix the tube pencil 308 in the handle 106. In this embodiment, where the implement comprises the pencil 308 for applying the eyeliner 310 to a portion of the body, the applicator 132 fixed to the first end 120(A) of the handle 106 may comprise an eyeliner brush. For example, the applicator 132 may comprise a brush arranged to provide precise application of the eyeliner 310. For example, the applicator 132 may comprise a brush having a wedge shaped group of bristles or a cone shaped group of bristles arranged to apply a precise line (e.g., winging) to a user's eye.

While the applicator 132 is illustrated as having a square shaped surface for grooming a portion of a body, the applicator 132 may be any other shape for grooming a portion of the body and/or applying a product to a portion of a body. For example, the applicator 132 may have a triangular shaped surface, a convex shaped surface, a cone shaped surface, or the like for grooming a portion of a body and/or applying product to a portion of a body. Further, while the applicator 132 is illustrated as being a group of bristles, the applicator 132 may additionally or alternatively comprise a sponge, a flocking, a paddle, a comb, a combination of any of the foregoing, or the like. The bristles may be formed of natural fibers (e.g., animal hair) or synthetic fibers (e.g., plastic or rubber), or the like. By way of example and not limitation, several alternative applicator shapes are shown in FIGS. 4A, 4B, 4C, 4D, and 4E.

Figure 4A:
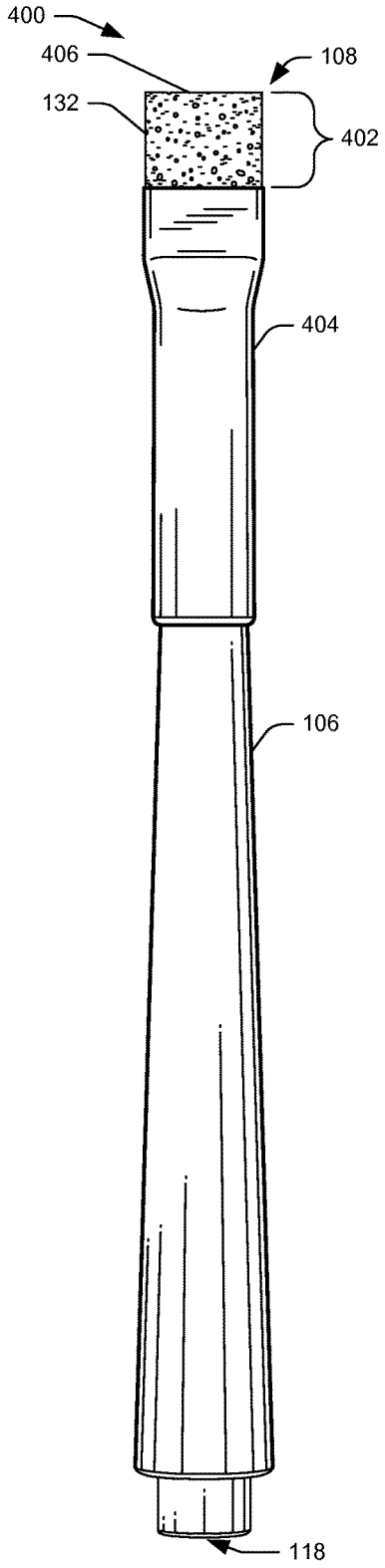
FIGS. 4A, 4B, 4C, 4D, and 4E each depict front views of example applicators that may be used with the two-in-one cosmetic system of FIG. 1, each applicator having a different shape. For instance, the applicators of FIGS. 4A-4E may include a cavity for receiving an implement such as the tweezers of FIG. 1, the implements of FIG. 3A or 3B, or other implements.
Figure 4B:
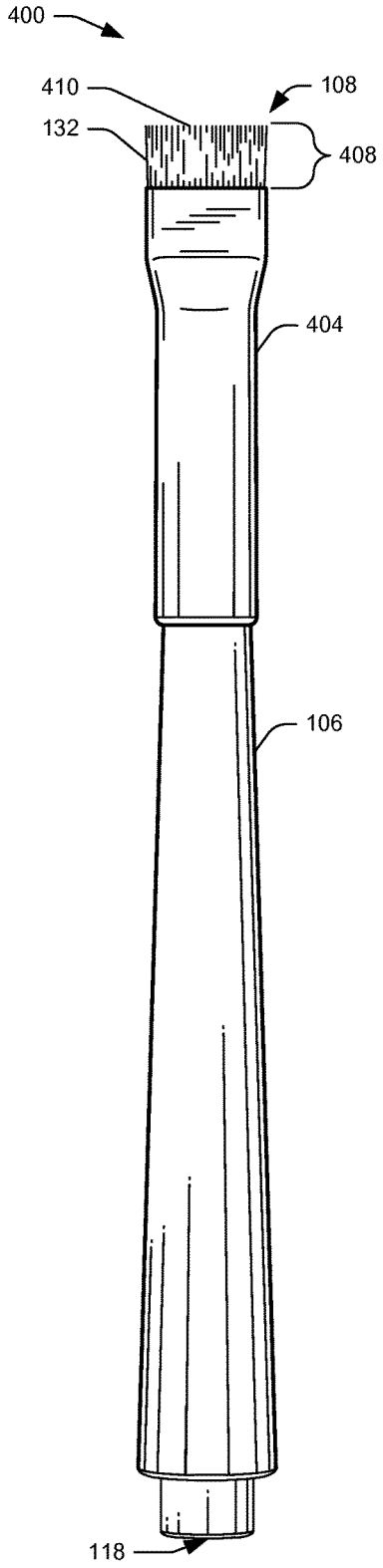
Figure 4C:
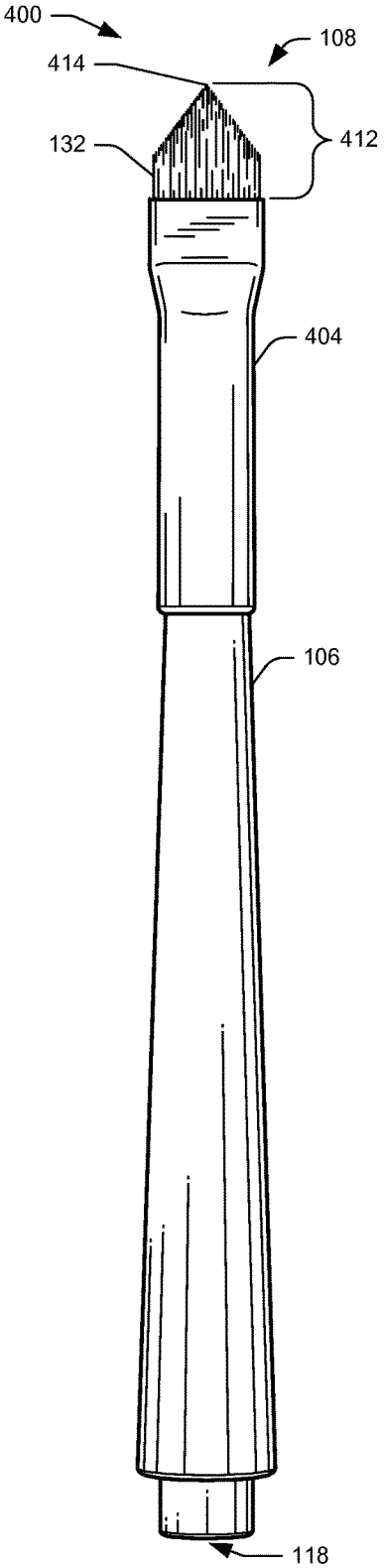
Figure 4D:
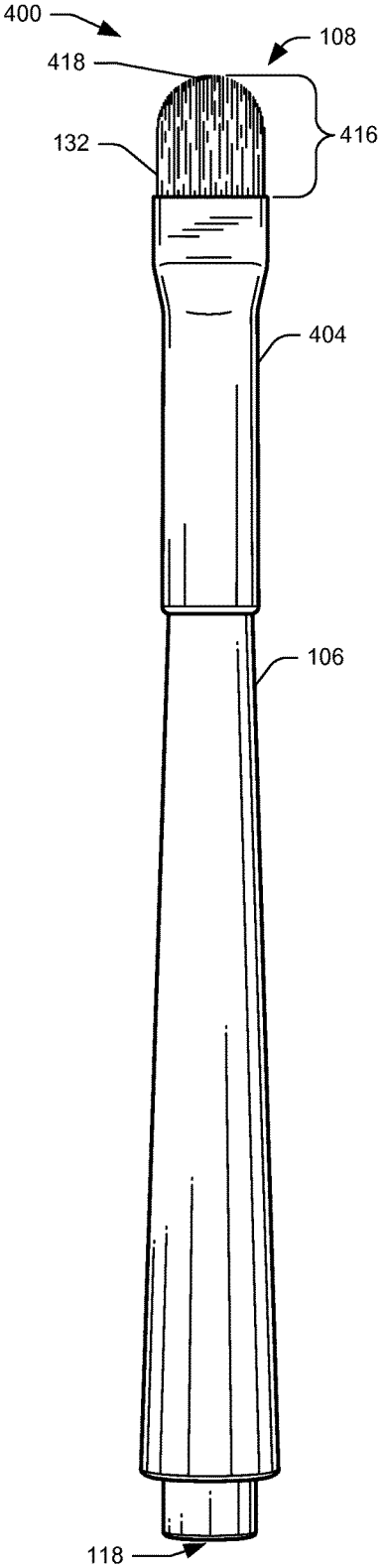
Figure 4E:
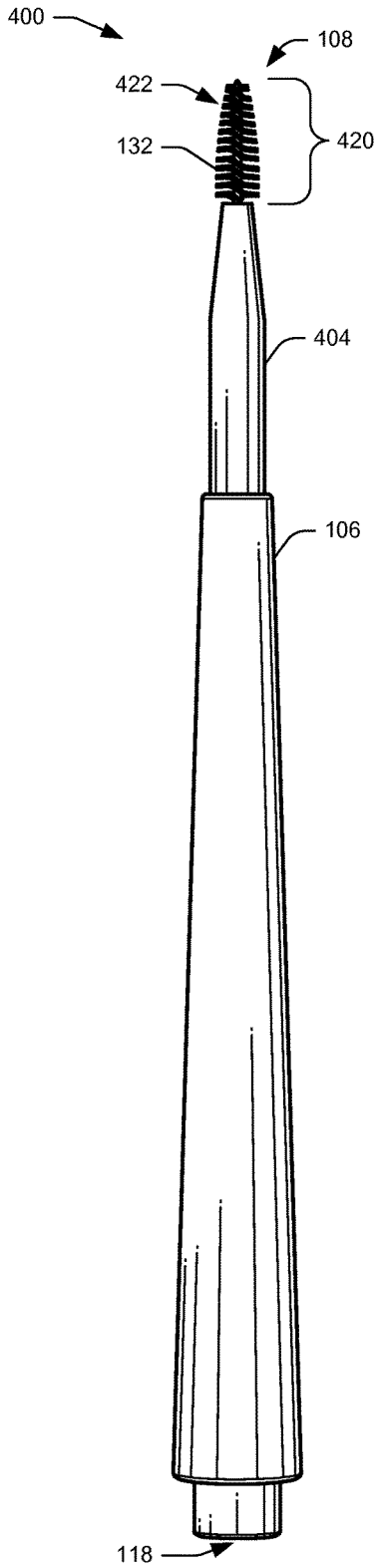

FIGS. 4A, 4B, 4C, 4D, and 4E depict a side view 400 of the brush 108 of the illustrative two-in-one cosmetic system 102 of FIG. 1. FIG. 4A depicts the applicator 132 may be a substantially flat rectangular shaped sponge 402 extending away from a ferrule 404 having a square shaped application surface 406. FIG. 4B depicts the applicator 132 may be a substantially flat rectangular shape group of bristles 408 extending away from the ferrule 404 having a square shaped application surface 410. FIG. 4C depicts the applicator 132 may be a substantially flat triangular shaped group of bristles 412 extending away from the ferrule 404 having a triangular application surface 414. FIG. 4D depicts the applicator 132 may be a substantially flat convex shaped group of bristles 416 extending away from the ferrule 404 having a convex application surface 418. FIG. 4E depicts the applicator 132 may be a substantially conical spiral shaped group of bristles 420 extending away from the ferrule 404 having a cylindrical application surface 422 (e.g., a spooly type applicator). These alternative applicator configurations are merely illustrative and other suitable applicator shapes may be used depending on the intended use of the two-in-one cosmetic system 102. Any of the implements described herein or other implements may be used with any of the applicators having a cavity described herein or other applicators.

CONCLUSION

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. For example, in various embodiments, any of the structural features and/or methodological acts described herein may be rearranged, modified, or omitted entirely. For example, the shape, size, and configuration of the tweezer, brush, and applicator may be varied.

What is claimed is:

1. A cosmetic system comprising:

a handle having an applicator fixed to and extending away from a first end of the handle, and a cavity defined by a surface arranged in a second end of the handle opposite the first end of the handle, an opening of the cavity being disposed in the surface arranged in the second end of the handle and the cavity extending towards the first end of the handle, the first end of the handle having a smaller diameter than the second end of the handle;

a tweezer comprising a pinching tip having cooperating edges for grooming a portion of the body, the tweezer removably disposed in the cavity; and a cap fixed to a fulcrum of the tweezer, wherein when the tweezer is removably disposed in the cavity, the pinching tip is held in a closed position by the surface of the cavity to keep the cooperating edges of the pinching tip undamaged, the pinching tip and the applicator form a substantially straight line such that the applicator extends substantially opposite the fulcrum of the tweezer, and wherein the second end of the handle has a substantially cylindrical exterior profile that provides a first gripping surface and a protruding portion extending away from the first gripping surface such that a radial width of the protruding portion is smaller than a diameter of the cylindrical exterior profile of the first gripping surface, and the cap has a recess and a substantially cylindrical exterior profile that provides a second gripping surface, such that when the cap is removably coupled with the second end of the handle by inserting the protruding portion into the recess, the first and second gripping surfaces form a single gripping surface having a continuously smooth exterior profile.

2. The cosmetic system according to claim 1, wherein the applicator fixed to the first end of the handle comprises a sponge.

3. The cosmetic system according to claim 1, wherein the applicator fixed to the first end of the handle comprises bristles.

4. The cosmetic system according to claim 3, wherein the bristles collectively provide a rectangular shape, a triangular shape or a convex shape.

* * * * *